US005704259A

United States Patent [19]

Riehle

[11] Patent Number: 5,704,259

[45] Date of Patent: Jan. 6, 1998

[54] HAND OPERATED IMPACT IMPLEMENT HAVING TUNED VIBRATION ABSORBER

[75] Inventor: Paul J. Riehle, Ann Arbor, Mich.

[73] Assignee: Roush Anatrol, Inc., Sunnyvale, Calif.

[21] Appl. No.: 551,991

[22] Filed: Nov. 2, 1995

[51] Int. Cl.[6] ..... B25D 1/12

[52] U.S. Cl. ..... 81/22; 81/20

[58] Field of Search ..... 81/20, 22

[56] References Cited

U.S. PATENT DOCUMENTS

| | | |
|---|---|---|
| 2,451,217 | 10/1948 | Heinrich . |
| 2,603,260 | 7/1952 | Floren . |
| 2,737,216 | 3/1956 | Kenerson . |
| 2,928,444 | 3/1960 | Ivins . |
| 3,030,989 | 4/1962 | Elliott . |
| 3,089,525 | 5/1963 | Palmer . |
| 3,208,724 | 9/1965 | Vaughan . |
| 3,613,753 | 10/1971 | Wolf . |
| 3,770,033 | 11/1973 | Gavillet et al. . |
| 3,844,321 | 10/1974 | Cook . |
| 4,085,784 | 4/1978 | Fish . |
| 4,172,483 | 10/1979 | Bereskin . |
| 4,287,640 | 9/1981 | Keathley . |
| 4,404,708 | 9/1983 | Winter . |
| 4,498,464 | 2/1985 | Morgan, Jr. . |
| 4,627,635 | 12/1986 | Koleda . |
| 4,660,832 | 4/1987 | Shomo . |
| 4,674,746 | 6/1987 | Benoit . |
| 4,683,784 | 8/1987 | Lamont . |
| 4,721,021 | 1/1988 | Kusznir . |
| 4,753,137 | 6/1988 | Kennedy . |
| 4,799,375 | 1/1989 | Lally . |
| 4,811,947 | 3/1989 | Takatsuka et al. . |
| 4,875,679 | 10/1989 | Movilliant et al. . |
| 4,936,586 | 6/1990 | Van Raemdonck . |
| 5,094,453 | 3/1992 | Douglas et al. . |
| 5,180,163 | 1/1993 | Lanctot et al. . |
| 5,259,274 | 11/1993 | Hreha . |
| 5,280,739 | 1/1994 | Liou . |
| 5,289,742 | 3/1994 | Vaughan, Jr. . |
| 5,362,046 | 11/1994 | Sims . |
| 5,375,486 | 12/1994 | Carmien . |
| 5,408,902 | 4/1995 | Burnett . |

FOREIGN PATENT DOCUMENTS

| | | | |
|---|---|---|---|
| 846702 | 8/1960 | United Kingdom | 81/22 |

*Primary Examiner*—James G. Smith
*Attorney, Agent, or Firm*—Bliss McGlynn, P.C.

[57] ABSTRACT

A hand operated impact implement having a tuned vibration absorber includes a head for impacting an object, a handle connected to the head, and a tuned vibration damper attached to the handle and/or head to damp overall handle/head vibration of the impact implement after impacting an object.

15 Claims, 6 Drawing Sheets

HAND OPERATED IMPACT IMPLEMENT HAVING TUNED VIBRATION ABSORBER

BACKGROUND OF THE INVENTION

1. Field of the Invention

The present invention relates generally to impact implements and, more particularly, to a hand operated impact implement having a tuned vibration absorber.

2. Description of the Related Art

Contact of a hand operated impact implement with an object being struck combined with structural dynamics of the implement initiates a vibration in the implement. The vibration is then transmitted along the implement and transferred to a user of the implement. The structural dynamics of the implement determine how much vibration from the impact is transformed to the user. The structural dynamics are defined by the mass, stiffness and damping of the hand operated impact implement. The mass, stiffness and damping properties combine to produce a series of implement resonances which amplify vibration at a grip end from impacts of the implement. The amount of vibration felt at the grip end is a function of the impact force and the mass, stiffness and damping of the implement.

An example of such a hand operated impact implement is a hammer. Typically, a hammer has a head and a handle attached to the head. In some hammers, the head and handle are integrally cast. The handle is commonly formed from either wood or a non-wood material such as steel or fiber reinforced plastic. Non-wood materials such as steel and fiber reinforced plastic are advantageous over wood because of their durability, especially in an overstrike condition.

However, one disadvantage of a non-wood handle is the amount of vibration these handles transmit to the hand and arm of the user. The vibration is high in non-wood handles since the damping property of these materials can be one hundred (100) to one thousand (1000) times less than a comparable wood handle. As a result, vibration in the non-wood handles is high, and with extensive use may result in fatigue of the arm and hand muscles of the user. This can affect the comfort and productivity of the user. In extreme cases of implement multiple use, physiological damage can occur in the hand/arm/shoulder of the user.

Several techniques for increasing damping in hand operated impact implements are disclosed in the following U.S. Pat. Nos.: 2,603,260 to Floren; 3,089,525 to Palmer; 4,660,832 to Shomo; 4,683,784 to Lamont; 4,721,021 to Kusznir; 4,799,375 to Lally; 5,180,163 to Lanctot et al.; and 5,280,739 to Liou. These patents have addressed vibration control with the means of a compliant handle and flexible grip. However, these implements suffer from the disadvantages of complexity of design, high cost of manufacturing and durability of the hand operated impact implement.

Another technique for controlling vibration in hand operated impact implements is to reduce the shock of impact before it enters the handle. This can be accomplished by an implement head which is shock mounted or isolated from its handle. Examples of these types of implements are disclosed in U.S. Pat. Nos. 2,928,444 to Ivins and 3,030,989 to Elliott. However, these implements suffer from the disadvantage of potential for wear, causing poor durability.

Still another technique for altering the vibration in hand operated impact implements is moving the center of percussion by adding a mass to the handle. An example of this type of implement is disclosed in U.S. Pat. No. 4,674,746 to Benoit. However, this implement suffers from the disadvantage that it is limited in ability to reduce vibration since it does not provide increased vibration damping.

Another technique for controlling vibration in hand operated impact implements is disclosed in U.S. Pat. Nos. 3,208,724 to Vaughn and 5,289,742 to Vaughn, Jr. These patents address damping relative to the head of the hammer. Vaughn and Vaughn Jr. utilize a pocket in the head, typically filled with wood and/or elastomer to dissipate vibration in the hammer head. However, these hammers have a positive effect on claw fracture and head vibration but are not effective for the overall hammer head/handle vibration.

Another technique which addresses hammer vibration control is disclosed in U.S. Pat. No. 5,362,046 to Sims. This patent discloses the use of a mushroom-shaped vibration damper for controlling impact implement vibration. The mushroom-shaped damper is made of a uniform elastomer and can be applied internally and externally to an impact implement handle. The mushroom-shaped damper functions by having an elastomer stem which provides a stiffness and damping element, and elastomer cap which provides a mass element. By its design, the cap motion causes bending in the stem which decreases the rate of decay of vibration set up in the implement by the impact. However, one disadvantage of this damper, when it is placed externally on the implement, is poor durability, especially in the application to hand operated impact implements. For example, the mushroom-shaped damper will easily get knocked off due to the inherent rough use of hand operated impact implements. Another disadvantage of this damper is that the cap is made of an elastomer instead of a high density material. As a result, the damper requires more volume of the elastomer to achieve a given mass needed for optimum vibration reduction and will require more packaging space. Due to small confines inside most impact implement handles, the mushroom-shaped damper will not be able to incorporate a large cap (mass), and hence its vibration reduction performance, which is a function of the mass, will be limited. Thus, there is a need in the art for reducing vibration in hand operated impact implements which provides the benefits of small packaging space, low manufacturing complexity, low cost, high durability, and high levels of vibration damping of the overall handle/head configuration.

SUMMARY OF THE INVENTION

It is, therefore, one object of the present invention to provide a hand operated impact implement having high vibration damping.

It is another object of the present invention to provide a hand operated impact implement with a tuned vibration absorber for vibration control of the implement.

It is yet another object of the present invention to provide a hand operated impact implement with a tuned vibration absorber for vibration control of the implement that reduces vibration transmitted to the hand and arm of the user of the implement.

It is a further object of the present invention to provide a hammer with a tuned vibration absorber for vibration control of the hammer.

To achieve the foregoing objects, the present invention is a hand operated impact implement including a head for impacting an object, a handle connected to the head and a tuned vibration absorber attached to the handle to reduce overall handle/head vibration of the implement after impacting an object.

One advantage of the present invention is that a hand operated impact implement is provided having high vibration damping. Another advantage of the present invention is that the hand operated impact implement has a tuned vibration absorber for vibration control of the implement. Yet another advantage of the present invention is that the tuned vibration absorber reduces vibration transmitted to the user from grasping the grip end of the handle of the hand operated impact implement. Still another advantage of the present invention is that the tuned vibration absorber is provided for a hammer that increases the damping of the overall handle/head configuration of the hammer. A further advantage of the present invention is that the tuned vibration absorber does not affect the impact efficiency or durability of the hammer.

Still a further advantage of the present invention is that the tuned vibration absorber provides a more efficient way to reduce hand operated impact implement vibration than other techniques currently in the art. Another advantage of the present invention is that the tuned vibration absorber, for its size and manufacturing cost, increases the damping to a greater level than other devices. For example, the tuned vibration absorber utilizes a small mass that is coupled to an elastomer and can increase the damping level of the hand operated impact implement by a factor up to ten (10) or more. Since the mass is made of a relatively high density material moving in shear, tension/compression or bending, the space required to package the tuned vibration absorber is very small and can be placed inside a hand operated impact implement easily without incurring high manufacturing costs and extensive manufacturing process changes. Still another advantage of the present invention is that the tuned vibration absorber does not change the normal function, the performance or the durability of the hand operated impact implement. The hand operated impact implement can still impart the same impact forces in the case of hammers since the present invention attenuates vibration after the impact forces have occurred.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
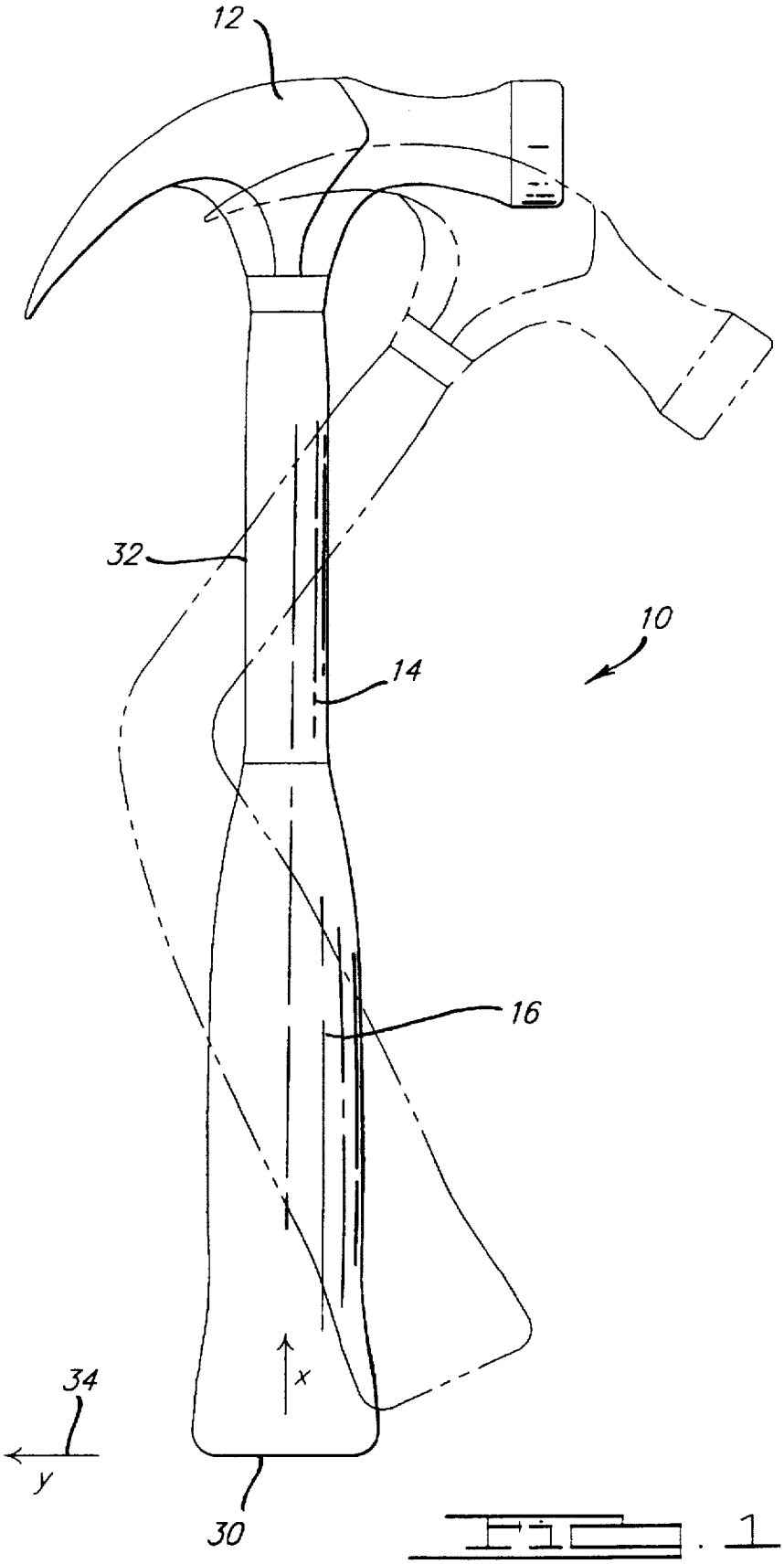
FIG. 1 is an elevational view of a hand operated impact implement illustrating a first bending resonance after striking an object.

Referring to FIG. 1, one embodiment of an impact implement, such as a hand operated impact implement, is generally shown at 10. The implement 10 typically includes an impact surface or head 12 for contacting or impacting an object and a handle 14 connected at one end to the head 12 for gripping the implement 10. The implement 10 may include a grip cover 16 at a lower free end of the handle 14, whereby the user grasps the implement 10. The head 12 is made of a non-wood material such as steel. The handle 14 is made of a non-wood material such as steel or composite material. The grip cover 16 is made of an elastomeric material such as rubber. It should be appreciated that a hammer is illustrated as an example of the hand operated impact implement 10 and includes all types of hand operated impact implements and tools such as a claw hammer, ball pein hammer, sledge hammer, dead blow hammer, ax, hatchet, pick, drywall hammer and masonry hammer.

Referring to FIG. 1, a first bending resonance or pattern for the hand operated impact implement 10 is illustrated. In this particular example, the handle 14 is made of a graphite composite. The amount of vibration felt at the lower end of the handle 14 is a function of the impact force, mass, stiffness and damping characteristics of the hand operated impact implement 10. The solid line illustrates the hand operated impact implement 10 in an undeformed shape and the phantom line illustrates the bending pattern of the handle 14 resulting from the implement 10 striking an object and vibrating at a first bending resonance of two hundred ninety Hertz (290 Hz) in the direction of a typical impact. The highest amplitude for a vibration response tends to occur at the lower end 30 of the handle 14 and in a middle portion 32 of the handle 14. It should be appreciated that the first bending resonance in the direction of a typical impact is the most critical for vibration felt at the lower end of the handle 14. It should also be appreciated that, if the hand operated impact implement 10 is impacted laterally (Z-direction), the resonance frequency is the lateral (Z-direction) or first bending mode with similar node points and maximum deflection points as illustrated in FIG. 1. It should be appreciated that the bending pattern shows deflection in the lateral (Z-direction).

Figure 2:
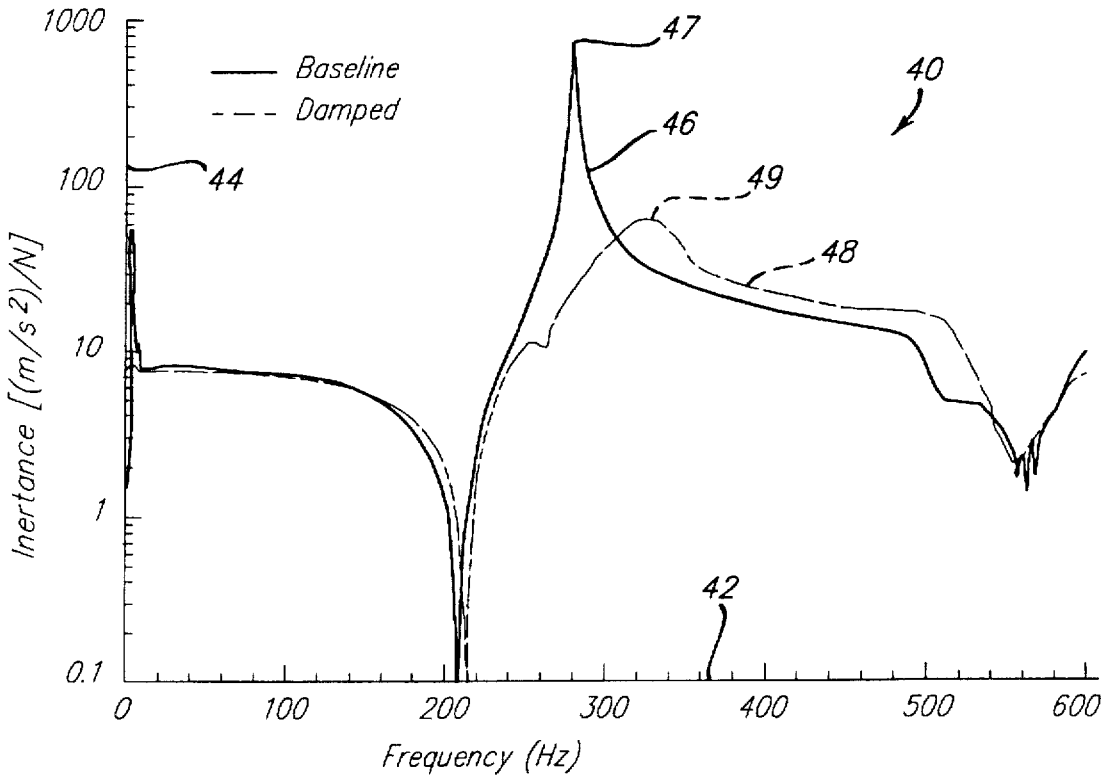
FIG. 2 is a graph illustrating inertance versus frequency for the implement of FIG. 1 and for a hand operated impact implement having a tuned vibration absorber according to the present invention.

Referring to FIG. 2, a graph of inertance versus frequency for the hand operated impact implement 10 is illustrated. A driving point frequency response 40 is measured at point 30 on the lower end of the handle 14 (FIG. 1) in the y-direction 34 using a device such as an accelerometer (not shown) and an instrument impact hammer (not shown). The x-axis represents the frequency 42 measured in Hertz (Hz) for this example. The y-axis 44 displays inertance measured in [(m/s$^2$)/N] for this example. The measurement peak 47 identifies the first bending resonance in the y-direction 34 which is easily excited during use and responsible for the vibration that is felt by the user after the hand operated impact implement 10 strikes an object. The sharpness of the peak and the amplification of inertance at the resonance frequency are indications of how damped the handle 14 is. In this example, a baseline or undamped response 46 is compared to a damped response 48 for a hand operated impact implement 110 having a tuned vibration absorber, according to the present invention, to be described. The undamped peak, at point 47, is higher and sharper compared to the damped peak, at point 49, providing an indication of the effectiveness of the tuned vibration absorber in reducing the vibration response of a hand operated impact implement 10 striking an object. It should be appreciated that the first bending mode for the hand operated impact implement 10 has a loss factor (damping), for example, of 0.026, and the hand operated impact implement 110 having a tuned vibration absorber, according to the present invention to be described, has a loss factor, for example, of 0.134.

Figure 3A:
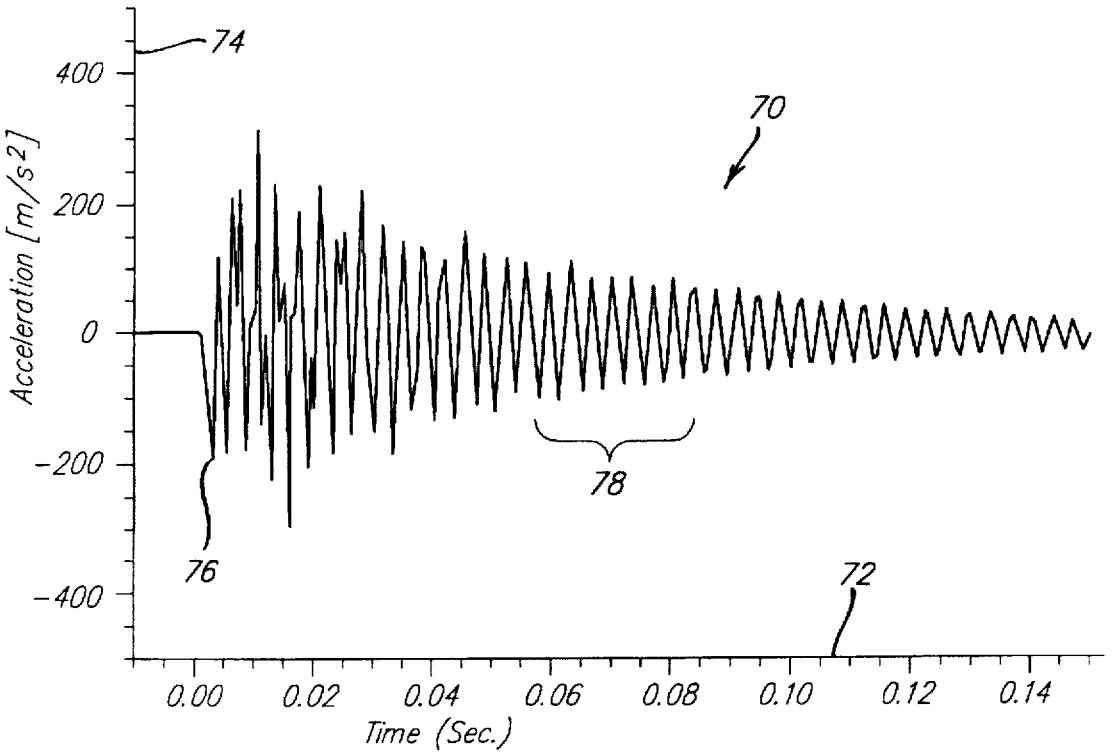
FIG. 3A is a graph of acceleration versus time for the implement of FIG. 1.

Referring to FIG. 3A, a vibration pattern of the hand operated impact implement 10 is illustrated. When the hand operated impact implement 10 strikes an object, the resulting vibration pattern, generally shown at 70, of the handle 14 over time can be measured using a device such as an accelerometer (not shown) mounted on the handle 14. The location and direction for this acceleration response measurement is the same as in FIG. 2. The x-axis 72 represents time, which in this example is measured in seconds. The y-axis 74 represents acceleration, which in this example is measured in (m/s$^2$). When an object is struck by the hand operated impact implement 10, there is an initial impulse amplitude 76 and an initial increasing vibration response for the first 0.02 seconds after the impulse, which decreases in an exponentially decaying manner 78. It should be appreciated that the oscillation frequency over time corresponds to the frequency of the first bending resonance. It should also be appreciated that the long decay time indicates minimal damping.

Figure 3B:
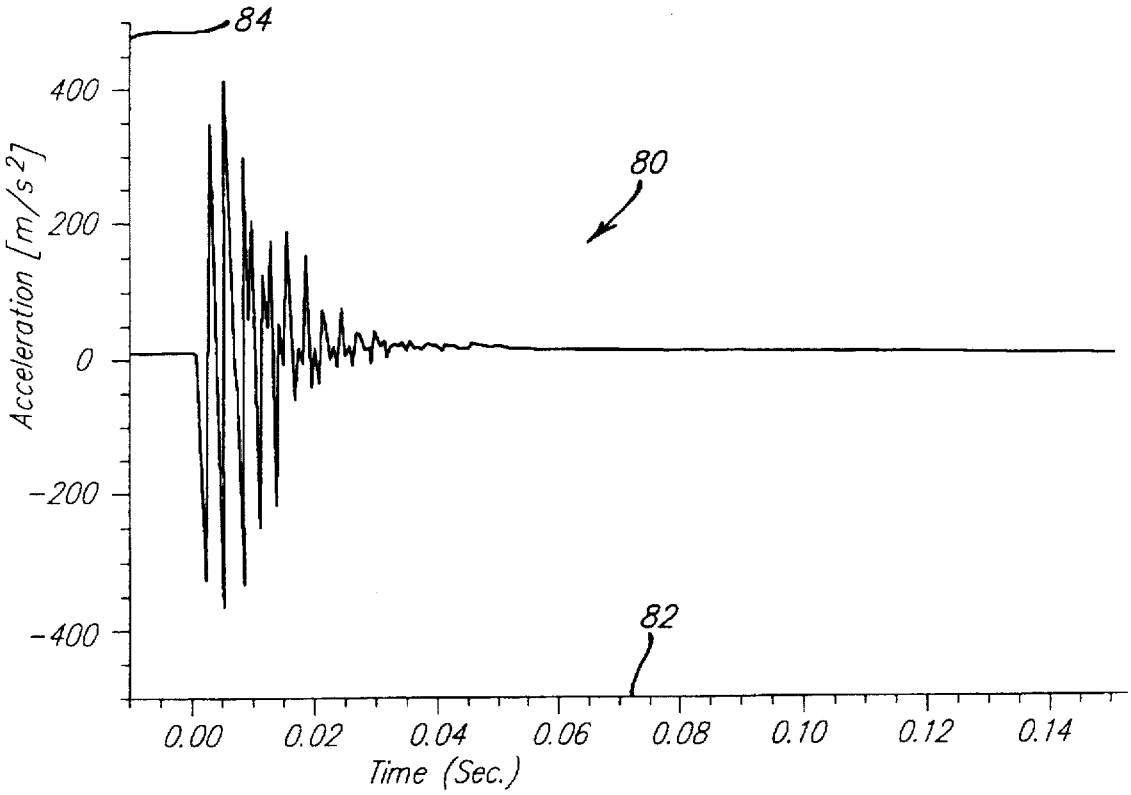
FIG. 3B is a view similar to FIG. 3A for a hand operated impact implement having a tuned vibration absorber according to the present invention.

Referring to FIG. 3B, a vibration pattern of a hand operated impact implement 110 having a tuned vibration absorber, according to the present invention, to be described, is illustrated. The vibration pattern generally shown at 80, for the handle over time is measured as previously described with regard to FIG. 3A. The x-axis 82 represents time, this example is measured in seconds, and the y-axis 84 represents acceleration which in this example is measured in (m/s$^2$). A direct comparison of the vibration pattern 80 of FIG. 3B with the vibration pattern 70 of FIG. 3A illustrates the vibration response decays over a very short time period. It should be appreciated that the addition of a tuned vibration absorber to a hand operated impact implement, such as a hammer, increases the damping level so that when the hammer strikes an object the vibration dies out faster, the hand/arm/shoulder vibration transmitted is reduced and the hammer has a more solid "feel" at the lower end of the handle.

Figure 4A:
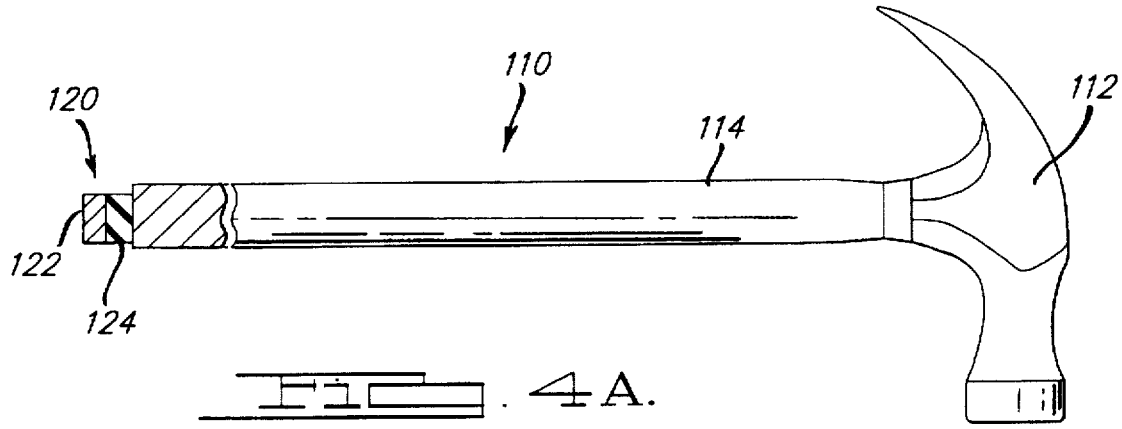
FIG. 4A is a fragmentary elevational view of a hand operated impact implement having a tuned vibration absorber according to the present invention.

Referring to FIG. 4A, one embodiment of a hand operated impact implement 110 having a tuned vibration absorber, according to the present invention, is illustrated. In this example, the impact implement 110 is a hammer of the claw type having a head 112 and a handle 114 attached to the head 112. The head 112 is made of a metal material such as steel and the handle 114 is made of a material such as steel, wood or fiber reinforced plastic having a urethane sleeve. The implement 110 includes a tuned vibration absorber or damper, generally indicated at 120, attached to an end of the handle 114. The tuned vibration absorber 120 includes a mass 122 and a damping element 124. The tuned vibration absorber 120 is an auxiliary vibrating mass which, when attached to a damping element, is tuned to vibrate at the bending resonance frequencies in the Y-direction and/or the Z-direction. The mass 122 is made of a high density material such as brass or steel and the damping element 124 is made of a lower density material such as rubber. Using a relatively high density material such as brass or steel for the mass 122 allows for better tuned vibration absorber performance in a given package space. If the mass 122 is made of a relatively low density material, it will require a larger volume of material to achieve the same mass as one made from brass or steel.

The tuned vibration absorber 120 is attached externally to the end of the handle 114 by suitable means such as mechanical fasteners, adhesives and/or press fit. It should be appreciated that the mass 122 and damping element 124 of the tuned vibration absorber 120 can take on any shape. However, the optimization of the material, size, and configuration of the mass 122 and damping element 124 of the tuned vibration absorber 120 yields a tuned vibration absorber that functions as a classical tuned absorber. For example, a properly tuned absorber can increase the damping level of an impact implement up to a factor of ten (10) or more. It should be appreciated that the mass 122 has a higher density than the damping element 124. It should also be appreciated that the tuned vibration absorber 120 can be applied to any wood or non-wood handle and damps the overall handle/head system vibration.

Figure 4B:
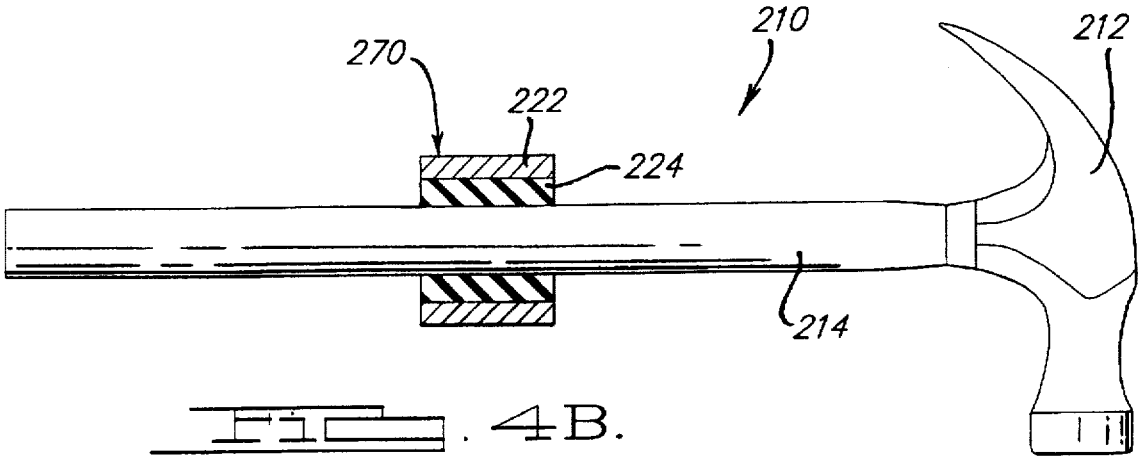
FIG. 4B is fragmentary elevational view of another hand operated impact implement having a tuned vibration absorber according to the present invention.

Referring to FIG. 4B, another embodiment of a hand operated impact implement 210 having a tuned vibration absorber, according to the present invention, is illustrated. Like parts of the impact implement 110 have like reference numerals increased by one hundred (100). In this example, the impact implement 210 includes the tuned vibration absorber 220 positioned externally along a middle section of the handle 214 and attached to the handle 214 as previously described. It should be appreciated that the positioning of the tuned vibration absorber 220 is dependent on the size and weight of the handle 214 and can be located at any location along the length of the handle 214.

Figure 4C:
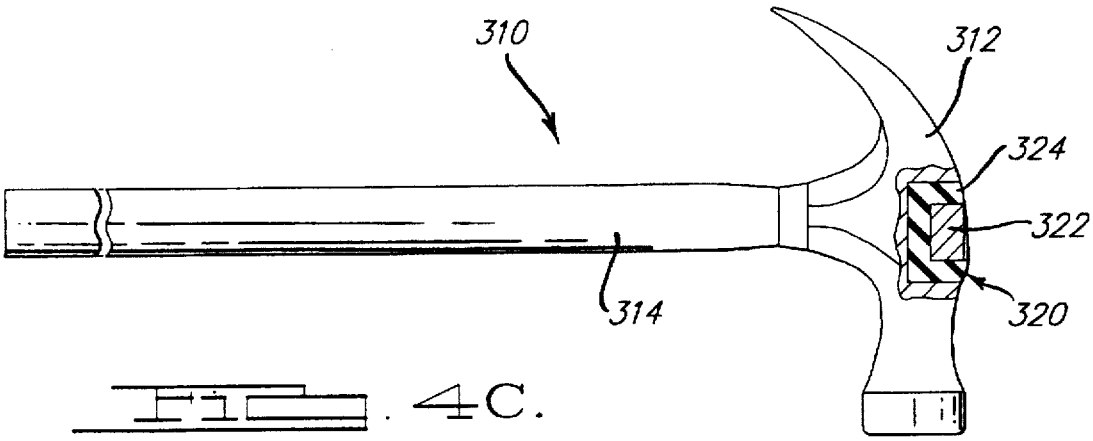
FIG. 4C is a fragmentary elevational view of yet another hand operated impact implement having a tuned vibration absorber according to the present invention.

Referring to FIG. 4C, yet another embodiment of a hand operated impact implement 310 having a tuned vibration absorber, according to the present invention, is illustrated. Like parts of the impact implement 110 have like reference numerals increased by two hundred (200). In this example, the impact implement 310 includes the tuned vibration absorber 320 positioned externally on the head 312 and attached to the head 312 as previously described. It should be appreciated that the positioning of the tuned vibration absorber 320 is dependent on the size and weight of the head 312. It should also be appreciated that the tuned vibration absorber 320 damps the overall handle/head vibration and not localized head vibration.

Figure 5A:
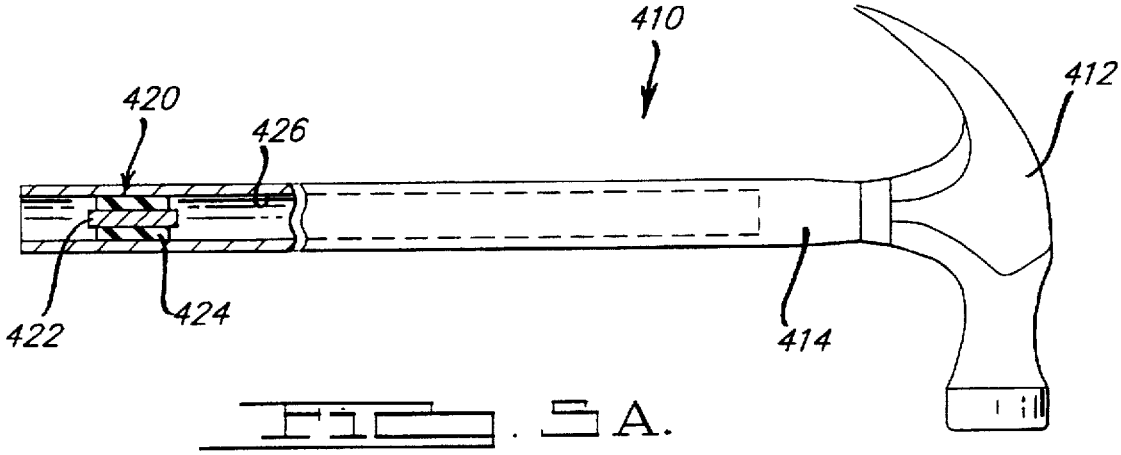
FIG. 5A is a fragmentary elevational view of still another hand operated impact implement having a tuned vibration absorber according to the present invention.

Referring to FIG. 5A, still another embodiment of a hand operated impact implement 410 having a tuned vibration absorber, according to the present invention, is illustrated. Like parts of the impact implement 110 have like reference numerals increased by three hundred (300). In this example, the impact implement 410 has the handle 414 with a hollow interior chamber 426, and the tuned vibration absorber 420 is disposed within the hollow interior chamber 426 of the handle 414 and attached thereto as previously described. It should be appreciated that the mass 422 and damping element 424 are positioned anywhere along the hollow interior chamber 426 of the handle 414 so as to obtain optimum vibration reduction.

Figure 5B:
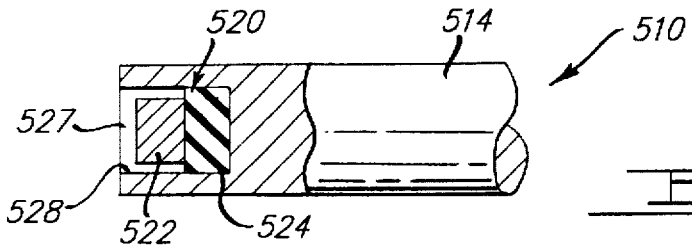
FIG. 5B is a fragmentary elevational view of a portion of another hand operated impact implement having a tuned vibration absorber according to the present invention.

Referring the FIG. 5B, another embodiment of a hand operated impact implement 510 having a tuned vibration absorber, according to the present invention, is shown. Like parts of the impact implement 110 have like reference numerals increased by four hundred (400). In this example, the impact implement 510 includes the handle 514 with a hollow recess 527 in one end of the handle 514. The tuned vibration absorber 520 is positioned within the hollow recess 527. The damping element 524 is attached to a wall 528 in the hollow recess 527 in the lower end of the handle 514, and the mass 522 is attached to the free side of the damping element 524 as previously described. It should be appreciated that there could be a space between the mass 522 and the wall 528 of the hollow recess 527.

Figure 5C:
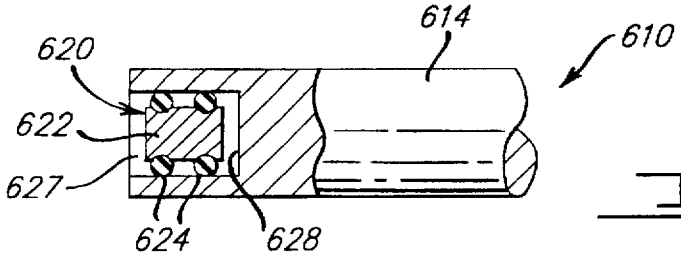
FIG. 5C is a fragmentary elevational view of a portion of yet another hand operated impact implement having a tuned vibration absorber according to the present invention.

Referring to FIG. 5C, another embodiment of a hand operated impact implement 610 having a tuned vibration absorber, according to the present invention, is illustrated. Like parts of the impact implement 110 have like reference numerals increased by five hundred (500). The impact implement 610 includes the handle 614 having the tuned vibration absorber 620 positioned within the hollow recess 627 in the end of the handle 614. The tuned vibration absorber 620 includes a mass 622 and, at least one, preferably a plurality of damping elements 624 located between the mass 622 and the wall 628 of the hollow recess 627 in the end of the handle 614. It should be appreciated that the damping elements 624 may have any suitable shape.

Figure 6:
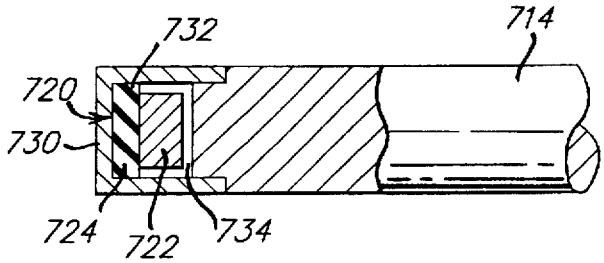
FIG. 6 is a fragmentary elevational view of a portion of still another hand operated impact implement having a tuned vibration absorber according to the present invention.

Referring to FIG. 6, another embodiment of a hand operated impact implement 710 having a tuned vibration absorber, according to the present invention, is illustrated. Like parts of the impact implement 110 have like reference numerals increased by six hundred (600). The impact implement 710 has the tuned vibration absorber 720 positioned within a cap 730 having a cup-like shape. The cap 730 is located at the end of the handle 714 of the impact implement 710. The damping element 724 can be attached to an interior wall 732 of the cap 730, and the mass 722 can be attached to the damping element 724. It should be appreciated that there may be a space 734 between the tuned vibration absorber 720 and the free end of the handle 714.

Figure 7:
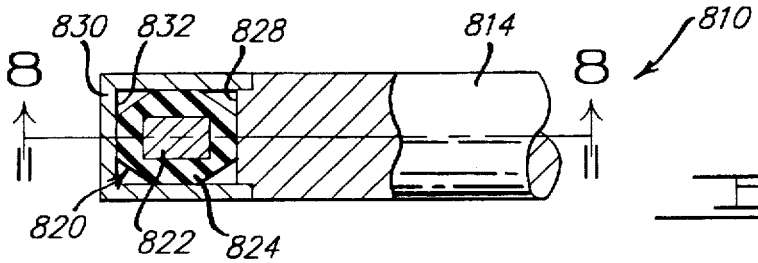
FIG. 7 is a fragmentary elevational view of a portion of another hand operated impact implement having a tuned vibration absorber according to the present invention.
Figure 8:
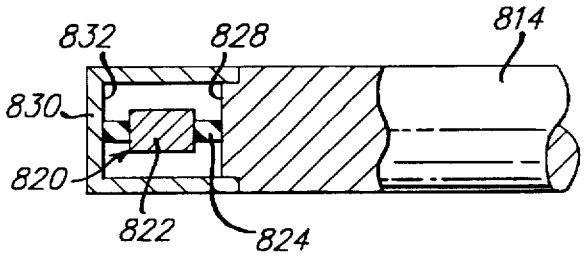
FIG. 8 is a sectional view taken along line 8—8 of FIG. 7.

Referring to FIGS. 7 and 8, another embodiment of a hand operated impact implement 810 having a tuned vibration absorber, according to the present invention, is illustrated. Like parts of the impact implement 110 have like reference numerals increased by seven hundred (700). The impact implement 810 has the tuned vibration absorber 820 positioned within a cap 830 having a cup-like shape. The cap 830 is located at the end of the handle 814 of the impact implement 810. The damping element 824 is attached to an interior wall 832 of the cap 830 and a wall 828 of the handle 814. The mass 822 is suspended by the damping element 824.

Figure 9:
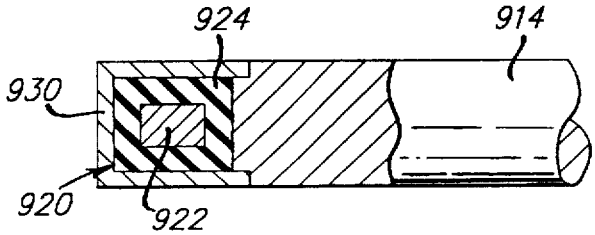
FIG. 9 is a fragmentary elevational view of a portion of yet another hand operated impact implement having a tuned vibration absorber according to the present invention.

Referring to FIG. 9, another embodiment of a hand operated impact implement 910 having a tuned vibration absorber, according to the present invention, is illustrated. Like parts of the impact implement 110 have like reference numerals increased by eight hundred (800). The impact implement 910 has the tuned vibration absorber 920 positioned within a cap 930 having a cup-like shape. The cap 930 is located at the end of the handle 914 of the impact implement 910. The damping element 924 can be attached to an interior wall 932 of the cap 930 and a wall 928 of the handle 914. The mass 922 is encapsulated by the damping element 924.

Figure 10:
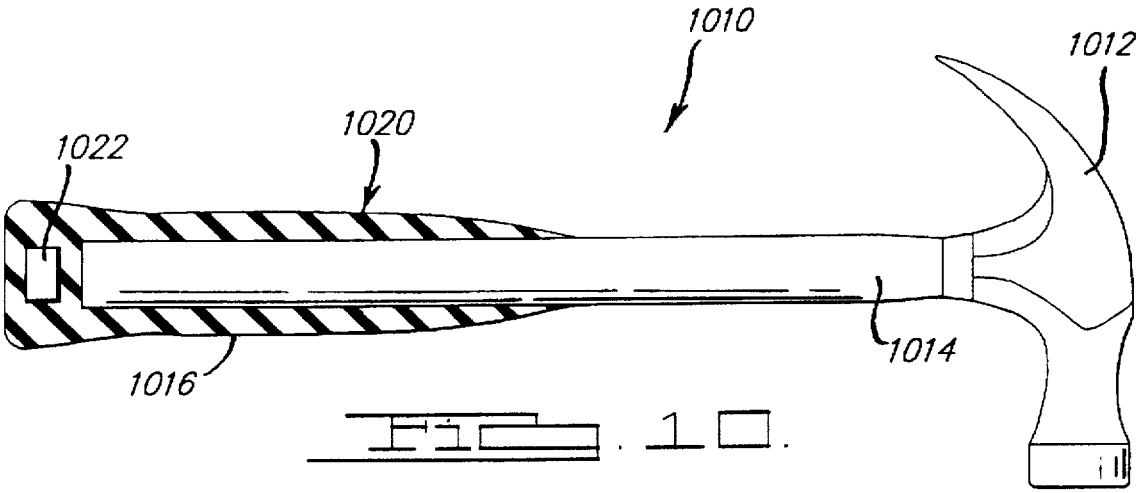
FIG. 10 is a fragmentary elevational view of another hand operated impact implement having a tuned vibration absorber according to the present invention.
Figure 11:
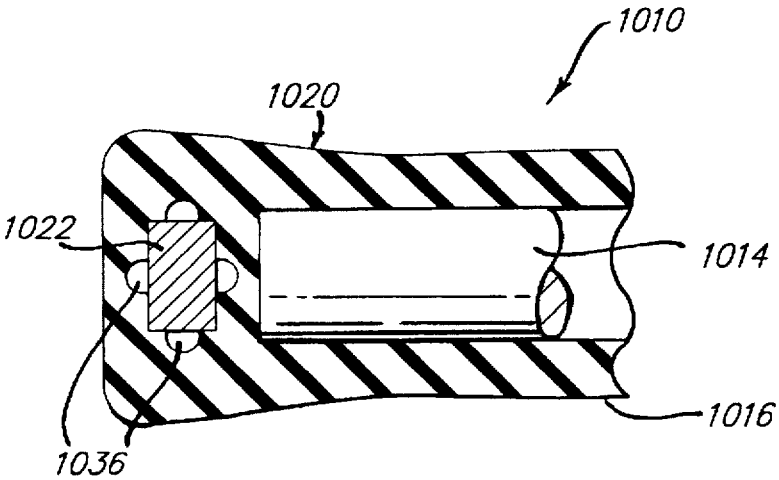
FIG. 11 is an enlarged fragmentary elevational view of a portion of the implement of FIG. 10.

Referring to FIGS. 10 and 11, another embodiment of a hand operated impact implement 1010 having a tuned vibration absorber, according to the present invention, is illustrated. Like parts of the impact implement 110 have like reference numerals increased by nine hundred (900). In this embodiment, the impact implement 1010 includes the handle 1014 with a grip cover 1016 surrounding a lower end the handle 1014. The grip cover 1016 may be fabricated from an elastomeric material such as rubber. The impact implement 1010 has the tuned vibration absorber 1020 as including the mass 1022, previously described, molded inside the grip cover 1016. The grip cover 1016 provides the characteristics of the spring and damping element of the tuned vibration absorber 1020. It should be appreciated that the grip cover 1016 can be formed so that it completely surrounds the mass 1022. As illustrated in FIG. 11, the grip cover 1016 can be formed such that at least one void 1036 exists between the grip cover 1016 and the mass 1022, for example, to control the stiffness of the tuned vibration absorber 1020 when the modulus of the grip material is too high. It should be appreciated that, in conjunction with FIGS. 4A, 4B, 4C, 5A, 5B, 5C, 6, 7, 8 and 9, the impact implement may include the grip cover surrounding the lower end of the handle to provide better ergonomic fit to the hand, cover the tuned vibration absorber, and offer some additional vibration isolation.

The tuned vibration absorbers of the present invention are tuned to specific frequency(s), have a high damping level, and are of a mass which is designed for optimum vibration reduction performance for the impact implement it is applied to. The variables which can be changed to optimize the performance include:

- Mass Element
  - material density
  - shape
- Rubber Element Stiffness
  - orientation: shear, tensions/compression, bending, torsion, . . .
  - material modulus: bulk, Young's, shear
  - shape
- Rubber Element Damping
  - material damping
- Absorber Tuning
  - mass/stiffness ratio It is the combination of these factors which determine the level of vibration reduction that can be achieved when a tuned vibration absorber is applied to an impact implement. It should be appreciated that the key element in the absorber is the proper selection of materials for the mass and the damping element.

The tuned vibration absorber includes the mass and the damping element. The damping element is a viscoelastic material and the stiffness is controlled by the modulus of elasticity and the dimensions of the material. The best approach to designing the tuned vibration absorber is to select a mass appropriate for the modal mass of the impact implement, and then choose a material with the proper modulus of elasticity and damping properties. The precise stiffness required to tune the absorber to the proper frequency is then controlled by the geometry of the damping element.

The simplest tuned vibration absorber is one incorporating a mass and a simple viscoelastic damping element in tension/compression. The resonance frequency of the mass is calculated from:

$$f_n = \frac{1}{2\pi}\sqrt{\frac{k}{m}} \quad (1)$$

Where: k=stiffness of the damping element and m=mass.

The stiffness of the damping element in tension/compression can be calculated from:

$$K_c = \frac{EA_1[1 + B(A_l/A_u)^2]}{h} \quad (2)$$

where E=Young's modulus of material

B=material constant

=2.0 for unfilled materials

=1.5 for filled materials $A_1$ =load carrying (stressed) area $A_u$ =non-load carrying (unstressed) area h=material thickness To obtain a desired resonance frequency, it is essential to know the material modulus. Since the modulus of viscoelastic materials vary as a function of temperature and frequency, the temperature and frequency of the tuned vibration absorber must be known before the damping element can be designed.

If the damping element is designed such that is undergoes shear deformation as the mass vibrates, the stiffness can be calculated from:

$$K_s = \frac{GA_1}{h[1 + (h/6R)^2]} \quad (3)$$

where G=shear modulus of material $A_1$=load carrying (stressed) area h=material thickness R=radius of gyration of shape Tuned vibration absorbers designed with more than one damping element require the overall stiffness of the series or parallel combination of the damping elements for calculating the resonance frequency.

The general process for designing the tuned vibration absorber for hand operated impact implements is described in a step-by-step fashion below. It should be appreciated that this is only one design for the tuned vibration absorber.

Step 1—MASS SELECTION

Based on frequency response testing of the hand operated impact implement and finding its overall baseline frequency response 46 as shown in FIG. 2, a modal mass can be calculated from the curve. The mass of the tuned vibration absorber is then calculated as a value equal to 5–20% of the baseline modal mass. Typically, 10% is a good starting value if it can be packaged in the available space.

Step 2—STIFFNESS CALCULATION

The next step is to determine the stiffness required for tuning. This is determined by utilizing the above Equation 1. Generally, this equation is solved such that the tuned vibration absorber resonance frequency, $f_n$, is equal to the resonance frequency 47 of the important mode of vibration of the hand operated impact implement. Depending on the selected mass and amount of tuned vibration absorber loss factor, the tuning may require that the frequencies be slightly different.

Step 3—OPTIMUM DAMPING CALCULATION

After the mass stiffness has been calculated, the optimum damping is calculated based on the desired damping increase. Generally, a material loss factor of 0.1–0.3 works best for tuned vibration absorbers which utilize a modal mass of 10% of the hand operated impact implement resonance modal mass.

Step 4—MATERIAL SELECTION

To keep the volume of the tuned vibration absorber mass to a minimum, it is most efficient to make the mass from brass or steel. Other high density materials could be utilized as well. The volume of material needed to achieve the desired mass can then be computed. It's overall dimensions can then be computed based on available package space.

The proper viscoelastic material selection is crucial to the successful application of the present invention. The viscoelastic damping material selection needs to take many factors into account as previously discussed. Generally, it is most important to select a material with modulus and damping properties which are linear with temperature if the hand operated impact implement will be used over wide ranging temperatures. Usually of secondary importance is linearity with respect to dynamic amplitude, frequency, and static preload. Many potential material candidates exist for hand operated impact implements such as silicone, EPDM, neoprene, nitrile and natural rubber. Preferably, moderately damped (0.05 to 0.2 loss factor) silicone rubber is used due to its linear temperature behavior.

Step 5—GEOMETRY DETERMINATION

Once the damping material and the motion of the damper (tension, compression, shear, or bending) have been selected, the actual geometry can then be determined. The geometry of the damping element is calculated using the above stiffness equations 2 and 3. The material modulus at the temperature, frequency, dynamic amplitude and static preload conditions for the hand operated impact implements of the selected damping material is used in the equations in conjunction with the needed stiffness value to determine the appropriate material thickness and cross-sectional areas.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A hand operated impact implement having vibration damping comprising:

a head for impacting an object;

a handle connected to said head;

a tuned vibration absorber attached to said handle to reduce overall handle/head vibration of said impact implement after impacting an object; and wherein said tuned vibration absorber is externally positioned on said handle near a middle portion of said handle.

2. A hand operated impact implement having vibration damping comprising:

a head for impacting an object;

a handle connected to said head;

a tuned vibration absorber having a mass and a viscoelastic damping element, whereby said mass and said damping element form at least one degree-of-freedom dynamic system tuned to vibrate near overall resonances of said impact implement and positioned internally within said handle of said impact implement.

3. A hand operated impact implement having vibration damping as set forth in claim 2 wherein said damping element is disposed between said mass and said handle.

4. A hand operated impact implement having vibration damping as set forth in claim 2 wherein said handle has a hollow interior chamber and said tuned vibration absorber is disposed within said hollow interior chamber.

5. A hand operated impact implement having vibration damping as set forth in claim 2 wherein said handle has a hollow recess in a gripping end of said handle and said tuned vibration absorber is positioned within said hollow recess.

6. A hand operated impact implement having vibration damping as set forth in claim 2 including a cap attached to a free end of the handle such that the cap extends beyond the free end of the handle.

7. A hand operated impact implement having vibration damping comprising:

a head for impacting an object;

a handle connected to said head;

a tuned vibration absorber having a mass and a damping element, whereby said mass and said damping element form at least one degree-of-freedom dynamic system tuned to vibrate near overall resonances of said impact implement and positioned either one of internally or externally along said handle of said impact implement; and wherein said damping element comprises at least one o-ring.

8. A hand operated impact implement having vibration damping comprising:

a head for impacting an object;

a handle connected to said head;

a tuned vibration absorber having a mass and a damping element, whereby said mass and said damping element form at least one degree-of-freedom dynamic system tuned to vibrate near overall resonances of said impact implement and positioned either one of internally or externally along said handle of said impact implement;

a cap attached to a free end of said handle such that said cap extends beyond the free end of said handle; and wherein said tuned vibration absorber is disposed within said cap.

9. A hand operated impact implement having vibration damping comprising:

a head for impacting an obiect;

a handle connected to said head;

a tuned vibration absorber having a mass and a damping element, whereby said mass and said damping element form at least one degree-of-freedom dynamic system tuned to vibrate near overall resonances of said impact implement and positioned either one of internally or externally along said handle of said impact implement; and wherein said damping element comprises a grip cover disposed around said handle and said mass is molded inside said grip cover so that said mass extends beyond a free end of said handle.

10. A hand operated impact implement having vibration damping comprising:

a head for impacting an object;

a handle connected to said head;

a tuned vibration absorber having a mass and a damping element, whereby said mass and said damping element form at least one degree-of-freedom dynamic system tuned to vibrate near overall resonances of said impact implement and positioned either one of internally or externally along said handle of said impact implement;

a grip cover disposed about said tuned vibration absorber and a gripping end of said handle; and said grip cover including a recess between said mass and an interior wall of said grip cover for controlling stiffness of said tuned vibration damper.

11. A hand operated impact implement having vibration damping comprising:

a head for impacting an object;

a handle connected to said head;

a tuned vibration absorber having a mass and a viscoelastic damping element, whereby said mass and said damping element form at least one degree-of-freedom dynamic system tuned to vibrate near overall resonances of said impact implement and positioned either one of internally or externally along said handle of said impact implement; and a grip cover disposed about said tuned vibration absorber and a gripping end of said handle.

12. A hand operated impact implement having vibration damping comprising:

a head for impacting an object;

a handle connected to said head; and a tuned vibration absorber having a mass and a viscoelastic damping element, said mass having a density greater than a density of said damping element, said tuned vibration absorber being positioned within said handle to damp overall handle/head vibration of said impact implement after impacting an object.

13. A hand operated impact implement having vibration damping comprising:

a head for impacting an object;

a handle connected to said head; and a tuned vibration absorber externally positioned on said handle and spaced from said head and a free end of said handle to reduce overall handle/head vibration of said impact implement after impacting an object.

14. A hand operated impact implement having vibration damping comprising:

a head for impacting an object and having a hollow recess;

a handle connected to said head; and a tuned vibration absorber positioned within said hollow recess and having a mass and a damping element, wherein said damping element is disposed between said mass and said head to reduce overall handle/head vibration of said impact implement after impacting an object.

15. A hand operated impact implement having vibration damping comprising:

a head for impacting an object;

a handle connected to said head;

a tuned vibration absorber having a mass and a damping element externally positioned on a free end of said of handle and a cap attached to the free end of said handle and enclosing said mass and said damping element such that said cap extends beyond the free end of said handle, whereby said mass and said damping element form at least one degree-of-freedom dynamic system tuned to vibrate near overall resonances of said impact implement after impacting an object.

* * * * *